US005729459A

United States Patent [19]

Brandien et al.

[11] Patent Number: 5,729,459

[45] Date of Patent: Mar. 17, 1998

[54] CARRIER MANAGEMENT SYSTEM HAVING A CAPABILITY TO DETERMINE WEIGHT BASED HANDLING CHARGES

[75] Inventors: Clint Francis Brandien, Prospect; Barbara Ellen Campbell, New Haven, both of Conn.

[73] Assignee: Pitney Bowes Inc., Stamford, Conn.

[21] Appl. No.: 887,620

[22] Filed: May 22, 1992

[51] Int. Cl.[6] ..... G07B 17/00

[52] U.S. Cl. ..... 364/464.12

[58] Field of Search ..... 364/464.02, 464.03, 364/464.12

[56] References Cited

U.S. PATENT DOCUMENTS

| | | | |
|---|---|---|---|
| 3,692,988 | 9/1972 | Dlugos et al. . | |
| 4,325,440 | 4/1982 | Crowley et al. | 177/25 |
| 4,339,807 | 7/1982 | Uchimura et al. | 364/464.17 |
| 4,349,981 | 9/1982 | Uchimura et al. | 364/464.12 |
| 4,351,033 | 9/1982 | Uchimura et al. | 364/464.12 |
| 4,366,552 | 12/1982 | Uchimura et al. | 364/464.17 |
| 4,376,981 | 3/1983 | Check, Jr. et al. | 364/570 |
| 4,495,581 | 1/1985 | Piccione | 364/567 X |
| 4,528,644 | 7/1985 | Soderberg et al. | 363/900 |
| 4,535,419 | 8/1985 | Dlugos et al. | 364/900 |
| 4,595,984 | 6/1986 | Daniels | 364/466 |
| 4,967,383 | 10/1990 | Hirano et al. | 364/567 |
| 5,070,463 | 12/1991 | Schuricht et al. | 364/464.02 |
| 5,072,397 | 12/1991 | Barns-Slavin et al. | 364/464.02 |

*Primary Examiner*—Edward R. Cosimano

*Attorney, Agent, or Firm*—Robert H. Whisker; Melvin J. Scolnick; Robert Meyer

[57] ABSTRACT

A carrier management system includes a scale for weighing parcels to be shipped, a computer connecting to receive data from the scale related to the weight of a parcel thereon, and a keyboard enabling operator input to the computer. The keyboard has a plurality of keys including a plurality of selection keys corresponding to separate ones or groups of the carriers and/or classes. The computer stores shipment charge data for a plurality of carriers and/or classes, on the basis of weight data from the scale. A second memory receives and stores weight range data and handling charge data from the keyboard, corresponding to handling charges applied to parcels for which selected classes of service are selected, and in accordance with the weight ranges. The computer is responsive to operation of the selection keys for applying handling charges stored in the second memory to any class of service to which they are applicable.

20 Claims, 6 Drawing Sheets

FIG. 4

| RANGE # | STARTING WT. | | ENDING WT. | |
|---|---|---|---|---|
| 1 | 0 lb. | 0.0 oz. | 0 lb. | 8.0 oz. |
| 2 | 0 lb. | 8.1 oz. | 0 lb. | 12.0 oz. |
| 3 | 0 lb. | 12.1 oz. | 1 lb. | 0.0 oz. |
| 4 | 1 lb. | 0.1 oz. | 2 lb. | 0.0 oz. |
| 5 | 2 lb. | 0.1 oz. | 5 lb. | 0.0 oz. |
| 6 | 5 lb. | 0.1 oz. | 10 lb. | 0.0 oz. |
| 7 | 10 lb. | 0.1 oz. | 20 lb. | 0.0 oz. |
| 8 | 20 lb. | 0.1 oz. | 30 lb. | 0.0 oz. |
| 9 | 30 lb. | 0.1 oz. | 40 lb. | 0.0 oz. |
| 10 | 40 lb. | 0.1 oz. | 50 lb. | 0.0 oz. |
| 11 | 50 lb. | 0.1 oz. | 60 lb. | 0.0 oz. |
| 12 | 60 lb. | 0.1 oz. | 70 lb. | 0.0 oz. |

DEFAULT WEIGHT RANGES

CARRIER MANAGEMENT SYSTEM HAVING A CAPABILITY TO DETERMINE WEIGHT BASED HANDLING CHARGES

BACKGROUND OF THE INVENTION

The subject invention relates to carrier management systems for enabling a user to determine the shipping charges for shipping of parcels by a selected carrier. More particularly, the subject invention is directed to such a system wherein handling charges can be determined based on carrier, class of service, and weight.

In the shipping of parcels, it is frequently desirable to provide for shipping by a carrier selected from a group of carriers. In current shipping practice, provision must be made for shipping of parcels by two major carriers; specifically the United States Postal Service (U.S.P.S.) and the United Parcel Service (UPS), a private carrier, as well as a large number of smaller private carriers. In prior tracking or recording systems, various data concerning parcels or groups of parcels to be shipped were entered by an operator, so that charges for each transaction, i.e. shipment of a parcel or consolidated group of parcels, could be determined. The data included information relating to the shipment, such as, the selection of the carrier, the number of parcels in a consolidated shipment, the weight of a parcel, delivery address data, invoice number, date, time, etc. Typically weight could be input either manually, through a keyboard, or automatically by a scale; while other data were generally entered by an operator through a keyboard, barcode reader, or similar input.

Such systems, typically, would then compute charges as a function of rates established by the selected carrier. Generally such systems would also perform such functions as printing manifest, shipping labels, postage indicia (for parcels shipped by USPS) and the like.

Such systems however did not include a capability for computing weight based handling charges. ("By handling charges" herein is meant a charge, over and above the shipping charges, collected by a third party who accepts a parcel or group of parcels from a shipper for later delivery to the selected carrier.)

Such prior art systems of this type are disclosed, for example, in U.S. Pat. Nos. 4,325,440; 4,495,581; and 4,595,984.

One such system is the G140 system, marketed by the assignee of the present application. The G140 includes a scale, microprocessor and keyboard and display, in a single integrated console. The G140 has the capability to weigh parcels; input shipment data, and determine charges, as described above; and may be connected to a printer for printing address labels and the like, and/or a postage meter for printing postage indicia (for parcels shipped by USPS) or to a UPS register for accounting for parcels shipped by UPS.

The G140 includes a limited capability for determining handling charges. During system configuration set-up a supervisor may set-up the G140 to automatically compute a handling charge as a percentage of the shipping charge, or a flat rate. The G140 also provides for direct, manual entry of handling charges.

U.S. Pat. No. 5,072,397; to: Barnes-Slavin et al.; issued: Dec. 10, 1991; for: Carrier Management System Enabling Determination of Charges With Discounts, describes a carrier management system which has a capability for handling discount rate structures. In this system a discount for the standard charge is defined by manually entering a discount as a percentage, flat rate, or sum of a percentage and flat rate, into the system during set-up for one or more classes of service selected from the plurality of classes of service available.

One application for carrier management system is in "store fronts". That is in commercial, retail operations which act as private post offices, renting mail boxes, selling stamps, etc. One function provided by such store fronts is accepting single or small groups of packages from individuals, preparing shipping labels, postage indicia, or other shipping documents using a carrier management system such as the G140, and later delivering the parcels to the selected carrier. In such store fronts it has been found desirable to provide a capability for determining handling charges on a more flexible, weight based basis; which capability is not provided in the G140 or suggested in the above mentioned U.S. Pat. No. 5,072,397.

It should be noted that the above mentioned '397 patent, while it does not teach weight based discounts, does teach discounts which are only allowed after a certain cumulative total dollar amount, number of pieces, or weight have been shipped using a particular class of service. (Note column 6, lines 15–31).

Thus, it is an object of the subject invention to provide a carrier management system having an easily implemented, and flexible system for determining handling charges.

BRIEF SUMMARY OF THE INVENTION

The above objects are achieved and the disadvantages of the prior art are overcome in accordance with the subject invention by means of a carrier management system which includes an input for input of parcel weight, a second input for input of data, the data including shipment data for selecting a class of service from a number of classes, handling charge data, and a configuration signal; a first memory for storing rate data; and a second memory for storing handling charge data, the handling charge data including weight range data defining a number of weight ranges for at least one of the classes of service and charge data defining handling charges for each of the weight ranges. A microprocessor, or similar data processing apparatus responds to the weight, shipment data and rate data to determine the shipment charges. If the selected class is a class for which handling charges have been defined, and the weight is within one of the associated weight ranges for the selected class, the microprocessor then determines the handling charges for the parcel. The microprocessor is also responsive to the configuration signal to enter a configuration set-up mode, and in that mode, input new weight range data redefining the weight ranges for at least one of the classes.

(It should be noted that carriers, generally, provide a plurality of different classes of service which may be selected by a shipper. Thus, typically, carrier management systems provide either for the direct selection of commonly used classes of service, e.g. USPS International, or by first selecting a carrier and then, if the selected carrier provides more then one class of service, selecting the class of service.)

In accordance with one of aspect of the subject invention the carrier management system has a capability for defining handling charges for a number of classes of service as a function of a single group of weight ranges.

In accordance with another aspect of the subject invention the weight ranges consisted of mutually exclusive ranges which completely cover the standard range of weights of parcels, so that each possible weight is in exactly one weight range. In accordance with another aspect of the subject invention the maximum weight of each weight range is less than the minimum weight of the next higher weight range (if a next higher weight range exists) by an increment less than or equal to the resolution with which the parcel weight is specified. New weight range data is input by entering, in order, either maximum or minimum weights for each weight range (thus defining the first weight in the next weight range); and the system recognizes that the group of weight ranges is complete when the corresponding limit of the standard weight range is input as a maximum or minimum weight of a weight range.

Thus it can be seen that the subject invention advantageously achieves the above objects and overcomes the disadvantages of the prior art. Other objects and advantages of the subject invention will become apparent to those skilled in the art from consideration of the attached drawings and the Detailed Description set forth below.

BRIEF DESCRIPTION OF THE DRAWINGS

FIG. 4 shows a table of default weight ranges which may be used in the subject invention.

DETAILED DESCRIPTION OF PREFERRED EMBODIMENTS OF THE SUBJECT INVENTION

Figure 1:
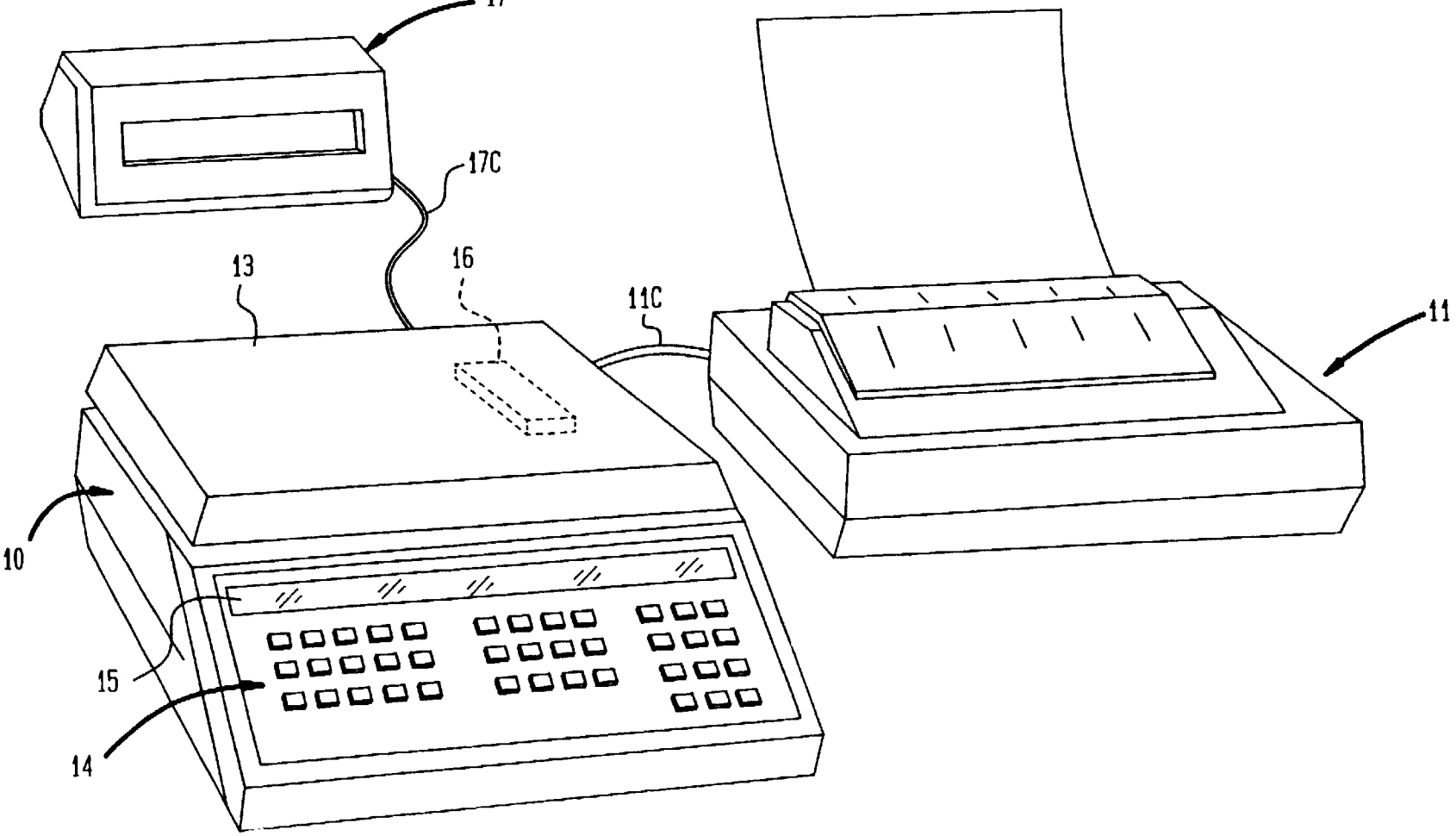
FIG. 1 is a perspective illustration of a carrier management system which may incorporate the present invention.

Turning to FIG. 1 a carrier management system in accordance with the subject invention includes a console 10 and a printer 11 connected to console 10 by cable 11*c*. The consoles supports platform 13 for receiving parcels to be weighed. The front panel of console 10 includes keyboard 14 and display 15. A replaceable board 16, shows in phantom, is mounted on or in console 10 below platform 13. Board 16 supports one or more read-only memories (ROM's) or programmable read/only memories (PROM's). Remote display 17 is connected to console 10 by cable 17C.

Figure 2:
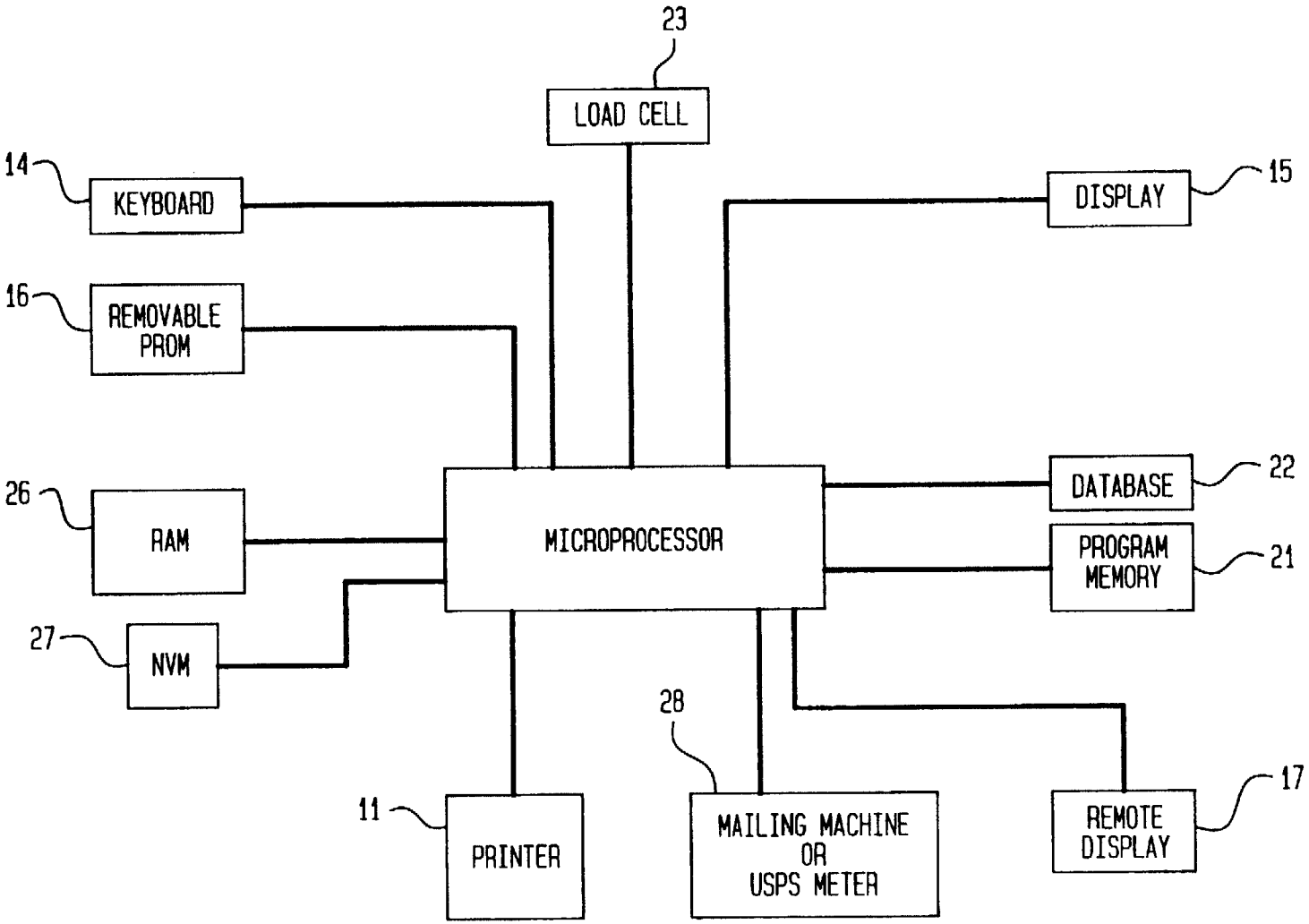
FIG. 2 is a block diagram of the system of FIG. 1.

FIG. 2 is a block diagram of the system of FIG. 1. The system incorporates microcomputer 20 having non-volatile program memory 21, for storing the program for operation of the system, and a non-volatile database memory 22 for storing rate data for all of the carriers and classes of service for which the system has the capability to determine shipping charges. Memory 22 is preferably replaceable PROM's so that the rate data may be updated from time to time. Load cell 23, which supports platform 13 inputs the weight for a parcel to be shipped which has been placed on platform 13 to microprocessor 20. Keyboard 14 is provided for input of shipment data, handling charge data, and a configuration signal, as will be described further below. Display 15 is provided to display various inputs, charges as computed, and prompts to an operator to elicit necessary inputs. Remote display 17 provides a limited display of information displayed on display 15 for the retail customer. Preferably display 15 will have the capability to selectively, separately display shipment charges and handling charges to the system operator, while remote display 17 will only display total charges to the customer.

Printer 11 is provided for printing reports and other documents as necessary in processing a parcel. In other embodiments of the subject invention the system may be provided with an additional printer internal to console 10 for printing of address labels and the like.

The system is also provided with random access memory (RAM) 26 to provide working storage and additional non-volatile memory 27 for storing certain critical parameters such as calibration constants. Removable PROM's 16 store data unique to the user of the system, and are replaceable by other PROM's in order, for example, to enable a service man to gain access to critical data stored in non-volatile memory 27.

In one embodiment of the subject invention microprocessor 20 is connected to a mailing machine or postage meter 28 for printing of postage indicia for parcels to be mailed. After computing the appropriate charge, not including, of course, any handling charge, microprocessor 20 downloads the charge to set meter 28 to the correct postage value, in a conventional manner well known to those skilled in the art.

Figure 3:
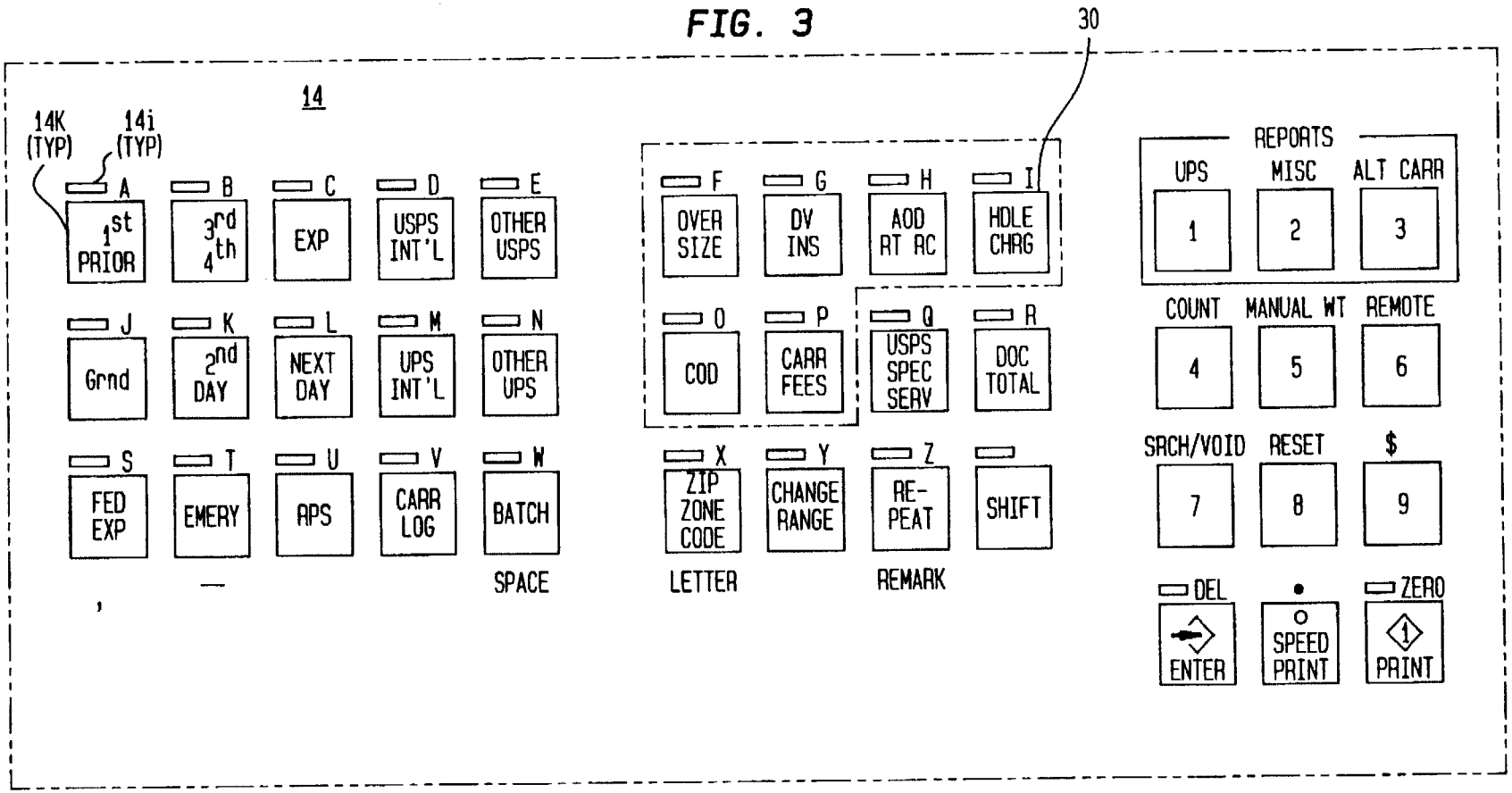
FIG. 3 is an illustration of the keyboard of the system of FIG. 1.

FIG. 3 shows keyboard 14 in greater detail. Keyboard 14 comprises a plurality of multi-function keys 14*k* which are used to input shipment data, select special functions, and provide other inputs as necessary for operation of the system. Certain of keys 14*k* are used to select particular classes of service for a particular carrier (e.g. USPS International) while others are used to select particular carriers (e.g. Federal Express) and selection of particular classes of service is input in response to prompts displayed on display 15 by the system. Other keys are used to input request for special services (e.g. COD).

Preferably lights 14*i*, positioned adjacent to certain of keys 14*k*, indicate that functions or modes controlled by those keys are active.

In general input of shipment data for operation of a carrier management system is well known, and is described in greater detail in the above reference U.S. Pat. No. 5,072,397, which is hereby incorporated by reference.

Further description of keyboard 14 and its use is not believed necessary for an understanding of the subject invention, except to note that, in accordance with one embodiment of the subject invention handling charge key 30 is provided in order to allow a system operator to cause display 17 to separately display the base charge and handling charge.

If the system is not configured to permit override of the automatic handling charge function, or if the operator does not chose to override the function, after determining the shipment charge for a parcel or group of parcels the system will then determine which of a plurality of weight ranges the parcel weight is in and then determine if handling charges are defined for the class of service selected for that parcel.

In accordance with a preferred embodiment of the subject invention the system requires that the weight ranges be mutually exclusive and cover the entire standard range of parcel weights for the system, and that if handling charges are defined for a class of service that they be defined for each weight range. Thus, if handling charges are defined for a class of service they will be uniquely defined for each parcel for which that class of service is selected.

Once the appropriate handling charge data is identified it will be applied to the shipment charge and the handling charge computed. As noted above, display 17 will only display a total charge, while display 15 may be controlled to display both the shipment charge and the separate handling charge, and only the shipment charge will be downloaded to postage meter 28.

FIG. 4 shows the default table of weight ranges defined for the system. The default table will be set if no values are input during configurations set-up, as will described below. Note that for each weight range the minimum weight is exactly 1/10th of an ounce greater than the maximum weight for the next lower range. This incremental value is chosen to be less than or equal to the resolution with which the parcel weight is input to assure that the weight ranges are mutually exclusive and cover the whole standard range of weights, from zero to 70 pounds.

As will be described below the system user will have defined handling charge data for each class of service for which the user wishes to charge a handling charge and input that data to the system. The handling charge data may define the handling charge in terms of a flat amount, a percentage of the shipment charge, or the sum of a flat amount and a percentage of the shipment charge.

Figure 5A:
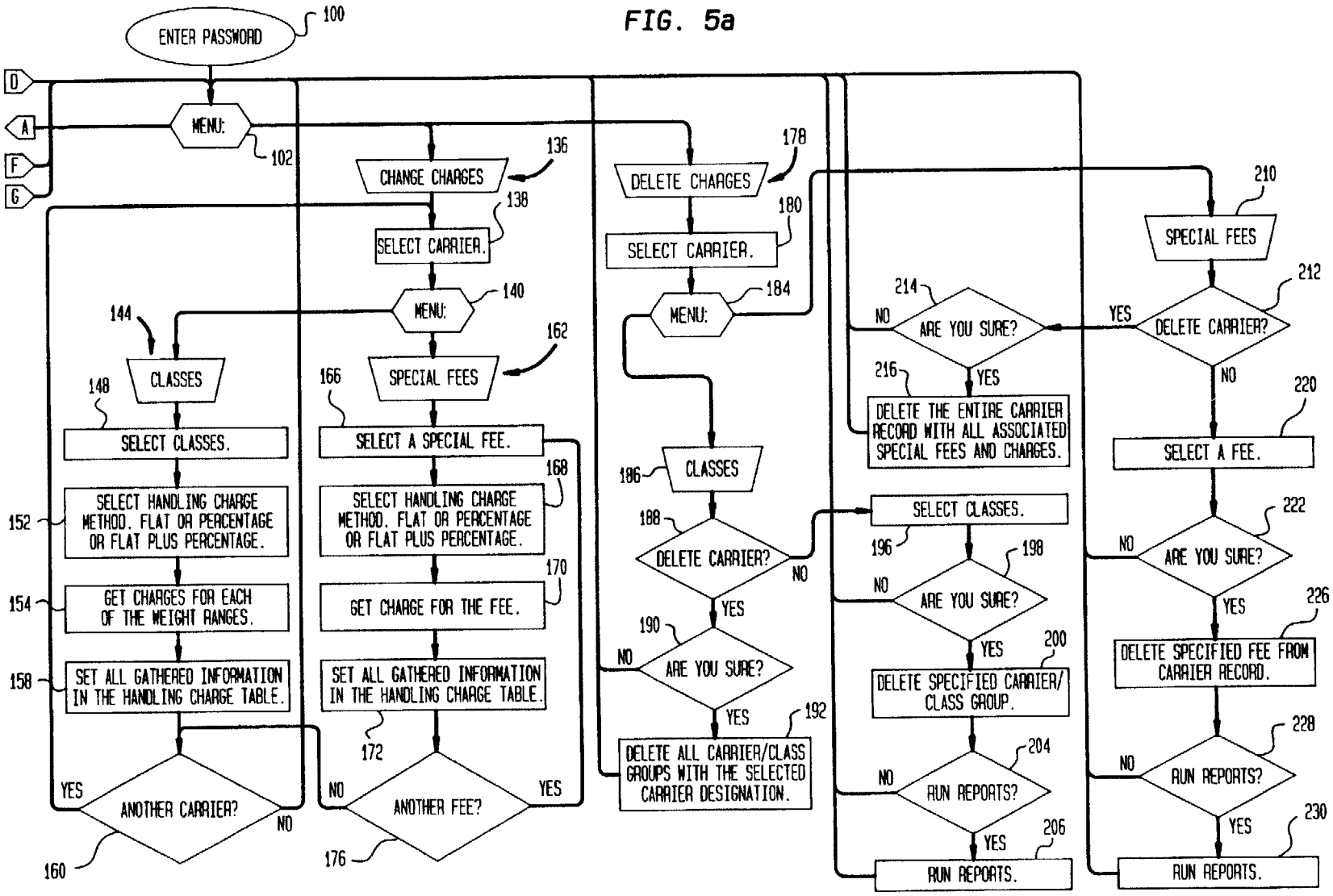
FIGS. 5*a* and 5*b* show a flow chart of the operation of the system of FIG. 1 in updating weight ranges.
Figure 5B:
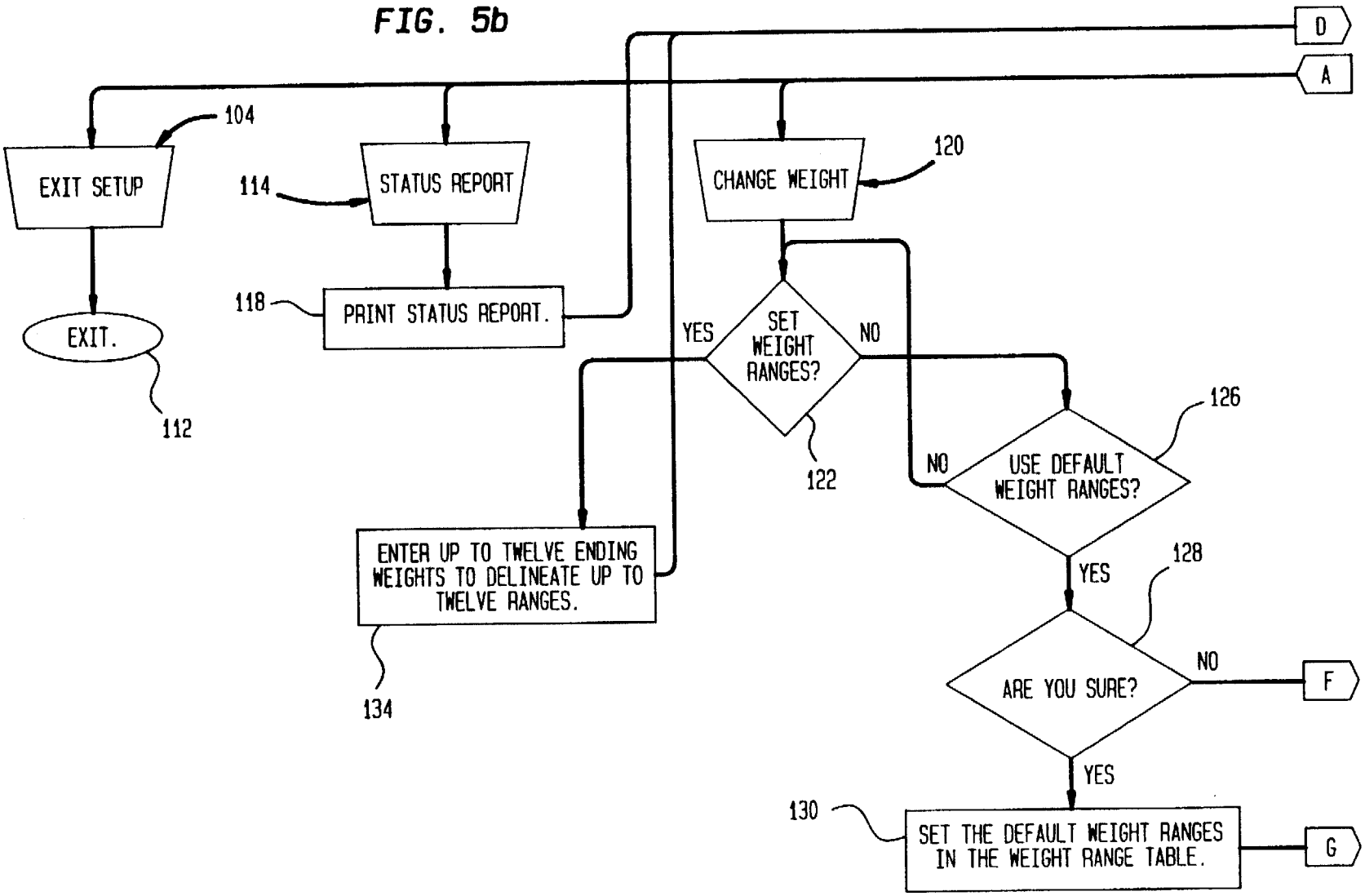

Turning now to FIGS. 5*a* and 5*b*, a flow chart of the operation of the system of the subject invention in setting up weight ranges and associated handling charges is shown. An operator enters a configuration set-up mode by entering a predetermined sequence of key strokes, e.g. "shift P". Then, at 100, the operator is prompted to enter a password and the system displays a menu 102. (Those skilled in the art will recognize that the configuration set-up mode may relate to other aspects of the system, but only those aspects relating to handling charges will be discussed in here for the sake of clarity.)

Turning now to FIG. 5*b*, if the operator selects Exit Setup function 104, the system exits the configuration set-up mode at 112.

If the operator selects Status Report function 114 the system will print a status report, as described above, at 118 and return to menu 102.

If the operator selects Change Weight function 120, then at 122 the system will ask if the operator wishes to set new weight ranges. If the operator answers yes, then at 134 the operator enters up to 12 weight values delineating the maximum weights for up to 12 weight ranges. When the operator enters a weight equal to the maximum standard weight i.e. the maximum weight (which can be weight on console 10) the system returns to menu 102.

The system sets minimum weights for each weight range, with the minimum weight for the first range being zero, and the minimum for each successive weight range being the maximum weight for the proceeding weight range plus an incremental amount less than or equal to the resolution with which weights may be input, typically 1/10th of an ounce.

In a preferred embodiment if all weigh values entered are not in strictly ascending order, or if a predetermined number of weight values are entered, typically 12, without entering the maximum standard value, an error message is displayed to the operator, and the operator must reenter the maximum weights.

If the operator answers no at 122, at 126 the system asks if the operator wishes to use the default weight ranges, e.g. those shown in FIG. 4. If the operator answers no the system returns to 122. If the operator answers yes, at 128 the system asks if the operator is sure, and if the operator answers no returns to menu 102. Only if the operator answers yes both at 126 and 128, will the system set the default weight ranges at 130, then return to menu 102.

Returning to FIG. 5*a*, if the operator selects Changes Charges function 136 then at 138 the operator is prompted to select a carrier, and menu 140 is displayed.

If the operator selects Classes function 144 from menu 140 then at 148 the operator may select the classes of service for the selected carrier for which handling charges are to be defined in accordance with weight ranges as delineated in Change Weight function 120, described above. Preferably, the system will provide the operator with the option to select a single class, select all classes for the selected carrier, or select a number of classes, typically from 2–4, between 1 and all classes for the selected carrier. Thus, by repeating Class function 136 the operator may define groupings of classes (of 1, 2–4, or all classes) for a selected carrier.

Once the classes are selected, then at 152 the operator selects the handling charge method. In a preferred embodiment of the subject invention the handling charge maybe computed as a flat rate, a percentage of the shipping charge, or as the sum of a flat rate and a percentage.

Then, at 154, the operator enters the charges for each weight range, and at 158 the information entered at 154 is stored. (Note that if the operator enters either more or less charges than there are weight ranges, or if the weight ranges are changed without corresponding changes to the handling charges, an error may occur. Accordingly, a status report is preferably printed after each change to the weight ranges or handling charges.)

Then at 160 system asks if handling charges are to be input for another carrier, and if the answer is yes, returns to 138. Otherwise the system returns to menu 102.

If the operator selects Special Fee function 162 then at 166 the operator is asked to select a special fee. Then, at 168, the handling charge method is selected, as described above. Then, at 170, the operator inputs the handling charge data for the selected special fee. (Note that weight ranges do not apply to handling charges for special fees and only one item of handling charge data is entered at 170.) Then at 172 the system stores the handling charge data, and at 176 asks if handling charges are to be delineated for another Special Fee. If the answer is no the system goes to 160 to determine if another carrier is to be selected, and if the answer is yes, the system goes to 166 to select another fee.

If the operator selects Delete Charges function 178 then at 180 the operator selects a carrier and goes to menu 184. If the operator selects classes function 186 then at 188 the system asks if the operator wishes to delete all handling charges for the selected carrier. If the operator answers yes, then, at 190, the system checks if the operator is sure, and if the answer is no returns to menu 102. If the answer is yes then, at 192, the system deletes all handling charges for all classes for the selected carrier and returns to menu 102.

If, at 188, the operator answers no, then at 196 the operator may select one, all, or a number of classes, as described above with respect to step 148. Preferably, in order to assure that the operator does not unwittingly delete charges, charges must be deleted for each grouping of classes exactly as that grouping was defined in Change Charges function 136. Then at 198 the system checks to determine if the operator is sure, and if the answer is no returns to menu 102. If the answer is yes, then at 200, the system deletes all handling charges for weight ranges for the selected carrier and specified classes.

Then, at 204, the system asks if the operator wishes a report run, and if the answer is no returns to menu 102. If the answer is yes, then at 206, the system displays a menu of reports so that the operator can print daily reports.

If at menu 184 the operator selects Special Fees function 210, then at 212 the system asks if the operator again wishes to delete all fees for the selected carrier. If the answer is yes, then at 214 and 216 all special fees are deleted for the selected carrier in substantially the manner described above with regards to steps 190 and 192. If the answer is no then at steps 220, 222, and 226 Special Fees are selected and deleted for the selected carrier substantially as described above with regard to steps 196, 198 and 200; except that Special Fees must be deleted one-by-one.

At 228 and 230 the system again runs reports as described above with respect to steps 204 and 206.

Numerous other embodiments of the subject invention will be apparent to those skilled in the art from consideration of the Detailed Description set forth above and the attached drawings. Particularly, through the preferred embodiments have been described in terms of separate memories, different areas of a single memory unit are considered fully equivalent to distinct memory units. Accordingly, limitations on the subject invention are to be found only in the claims set forth below.

What is claimed is:

1. A carrier management system comprising:

a) first means for input of weight for a parcel to be shipped;

b) second means for input of data, said data including shipment data for selecting a class of service from a plurality of classes, handling charge data, and a configuration signal;

c) a first memory for storing rate data;

d) second memory for storing said handling charge data, said handling charge data including weight range data defining a plurality of weight ranges for at least one of said classes, and charge data defining said handling charges for each of said weight ranges;

e) data processing means, responsive to said weight, said shipment data and said rate data, for determining shipment charges, and, if said at least one of said classes is said selected class and said weight is within one of said weight range for said selected class, for determining said handling charges for said parcel, and further responsive to said configuration signal for entering a configuration set-up mode and inputting new weight range data redefining said plurality of weight ranges for at least a selected one of said classes.

2. A system as described in claim 1 wherein said shipment data further includes special service data for selecting special services and said data processing means is further responsive to said special service data to determine additional shipment charges and additional handling charges.

3. A system as described in claim 1 wherein said at least one of said classes is selected in said configuration set up mode by first identifying a class from said plurality of classes, then for said identified class defining a handling charge to correspond to each weight range of said plurality of weight ranges.

4. A system as described in claim 3 having a capability for identifying an additional class by identifying said additional class from said plurality of classes and defining additional handling charges to correspond to each weight range of said plurality of weight ranges, whereby handling charges are defined for a plurality of classes in accordance with said plurality of weight ranges.

5. A system as described in claim 4 wherein said shipment data further includes special service data for selecting special services and said data processing means is further responsive to said special service data to determine additional shipment charges and additional handling charges.

6. A system as described in claim 4 wherein the maximum weight for each of said weight ranges, is less than the minimum weight of the next higher weight range (if a next higher weight range exists) by an increment less than or equal to the resolution with which said weight is specified and said new weight range data is input, in order, as either maximum or minimum weights for each of said weight ranges, and said system recognizes that said plurality of weight ranges is complete when the corresponding limit of said standard weight range is input.

7. A system as described in claim 6 wherein said system enters an error mode if a predetermined number of elements of said new weight range data are input and the corresponding limit of said standard weight range is not input.

8. A system as described in claim 6 wherein said system enters an error mode if said new weight range data is not entered in order.

9. A system as described in claim 8 wherein said system enters an error mode if a predetermined number of elements of said new weight range data are input and the corresponding limit of said standard weight range is not input.

10. A system as described in claim 4 wherein said plurality of weight ranges consists of mutually exclusive weight ranges and completely covers the standard range of said weights whereby each of said weights in said standard range is in exactly one of said weight ranges.

11. A system as described in claim 10 wherein the maximum weight for each of said weight ranges, is less than the minimum weight of the next higher weight range (if a next higher weight range exists) by an increment less than or equal to the resolution with which said weight is specified and said new weight range data is input, in order, as either maximum or minimum weights for each of said weight ranges, and said system recognizes that said plurality of weight ranges is complete when the corresponding limit of said standard weight range is input.

12. A system as described in claim 11 wherein said system enters an error mode if a predetermined number of elements of said new weight range data are input and the corresponding limit of said standard weight range is not input.

13. A system as described in claim 11 wherein said system enters an error mode if said new weight range data is not entered in order.

14. A system as described in claim 13 wherein said system enters an error mode if a predetermined number of elements of said new weight range data are input and the corresponding limit of said standard weight range is not input.

15. A system as described in claim 14 wherein said shipment data further includes special service data for selecting special services and said data processing means is further responsive to said special service data to determine additional shipment charges and additional handling charges.

16. In a system of the type which determines a charge as a function of a weight and a class of service selected from a plurality of classes, the improvement comprising:

a) a first memory for storing data defining a plurality of weight ranges;

b) second memory for storing a handling charge data associated with one of said weight ranges and one of said classes; and, c) means for determining is said weight is within said one weight range and said selected class is said one class, and if so, determining a handling charge as a function of said handling charge data and adding said handling charge to said charge.

17. A system as described in claim 16 wherein said plurality of weight ranges consists of mutually exclusive weight ranges and completely covers the standard range of said weights whereby each of said weights in said standard range is in exactly one of said weight ranges.

18. A system as described in claim 16 where said improvement further comprises a local display and a remote display, said local display displaying said charge and said handling charge separately to a system operator, and said remote display displaying only the sum of said charge and said handling charge to a customer.

19. A system as described in claim 16 wherein said handling charge data determines said handling charge as a percentage of said charge, or as a predetermined, fixed amount, or as the sum of a fixed amount and a percentage of said charge.

20. A system as described in claim 19 wherein said plurality of weight ranges consists of mutually exclusive weight ranges and completely covers the standard range of said weights whereby each of said weights in said standard range is in exactly one of said weight ranges.

* * * * *